United States Patent [19]

Blackwood

[11] 3,936,660

[45] Feb. 3, 1976

[54] HOT PLATE

[75] Inventor: Robert S. Blackwood, Chanhassen, Minn.

[73] Assignee: Fluoroware Systems Corporation, Chaska, Minn.

[22] Filed: Sept. 30, 1974

[21] Appl. No.: 510,148

[52] U.S. Cl. ..... 219/459; 99/422; 219/460; 219/464; 219/544

[51] Int. Cl.[2] ..... H05B 3/68

[58] Field of Search ..... 219/345, 451, 457, 459, 219/460, 462, 463, 464, 524, 525, 530, 544, 541; 99/372, 377, 422, 447

[56] References Cited

UNITED STATES PATENTS

| | | | |
|---|---|---|---|
| 1,174,030 | 2/1916 | Hadaway, Jr. | 219/460 |
| 1,237,592 | 8/1917 | White | 219/457 |
| 1,348,648 | 8/1920 | Kelly | 219/460 X |
| 1,654,292 | 12/1927 | Keene et al. | 219/459 |
| 2,644,880 | 7/1953 | Valentini et al. | 219/525 |
| 2,833,908 | 5/1958 | Scofield | 219/465 X |
| 2,978,564 | 4/1961 | Blanding et al. | 219/460 X |
| 3,043,943 | 7/1962 | Moot | 219/460 X |
| 3,172,072 | 3/1965 | Willy | 219/528 X |
| 3,622,753 | 11/1971 | Lax et al. | 219/464 |
| 3,733,462 | 5/1973 | Bouchard et al. | 219/464 |
| 3,870,861 | 3/1975 | Werych | 219/459 |

*Primary Examiner*—Volodymyr Y. Mayewsky
*Attorney, Agent, or Firm*—H. Dale Palmatier; James R. Haller

[57] ABSTRACT

This invention pertains to a hot plate and more specifically to an industrial hot plate for use in highly corrosive environments where chemicals of high acidity or high alkalinity are employed. An epoxy foam is utilized both to thermally isolate the heated surface from the base structure and to protect the heating element and the associated electrical circuit from damage from the active chemical agents that may be involved upon using the instant hot plate.

3 Claims, 3 Drawing Figures

HOT PLATE

This invention relates generally to hot plates and more particularly to industrial hot plates for use in highly corrosive environments including operations involving the use of active chemical agents of both high acidity and high alkalinity.

The prior art is replete with hot plates of the type disclosed. The more recent ones utilize ceramic materials for the heated working surface or top and, as such, these ceramic tops are very resistant to chemical reaction with virtually all of the various chemicals that may be employed as well as being capable of withstanding high temperatures. One such ceramic top made is commercially available from the Corning Glass Works in Corning, New York and can be purchased complete with a ribbon heating element, backing plate and mounting clips fully assembled less electrical power connectors and controls.

But even the most advanced designed hot plates, whether they employ the commercially available Corning Glass Works ceramic hot plate or other unknown but suitable substitutes, have failed to meet the specifications demanded in certain industries simply because the various base structures to which these ceramic tops are affixed are manufactured from materials which subsequently fail due to the corrosive chemicals employed. Then too, in many instances failure of the hot plate can be directly attributed to an inadequately protected electrical supply lines to the heating element, especially in those instances where the base structures stand on wet or liquid covered surfaces.

In the present invention, these undesirable characteristics are alleviated by providing a hot plate that is completely protected from any hostile environment. According to the invention, there is provided a hot plate comprising in combination a top portion having a heated working surface, a heating element operably disposed is the top portion below the working surface and having electrical terminals, circuit means for supplying electrical energy from a power source to the terminals, a base portion for operably supporting the top portion in thermal isolation therefrom, and means including epoxy foam for encapsulating the heating element and the circuit means to confine substantially all of the heat generated to the working surface.

It is therefore a primary purpose and objective of the invention to provide an improved hot plate.

It is another object of the invention to provide a hot plate of the type described that can be operated in a highly corrosive environment.

It is still another object of the invention to provide a hot plate of the type described that utilizes foam type materials to prevent chemicals of both high acidity and high alkalinity from reacting with the electrical components thereof.

It is yet another object of the invention to provide a hot plate of the type described that is provided with a non-corrosive base portion adapted to foam encapsulate the electrical components assembled therein.

Another object of the invention is to provide a hot plate of the type described that utilizes a foam type material to seal the electrical heating element from toxic and corrosive chemical substances.

These features, objects and other advantages of the invention are more fully brought out in the following specifications, reference being had to the drawing wherein.

Figure 1:
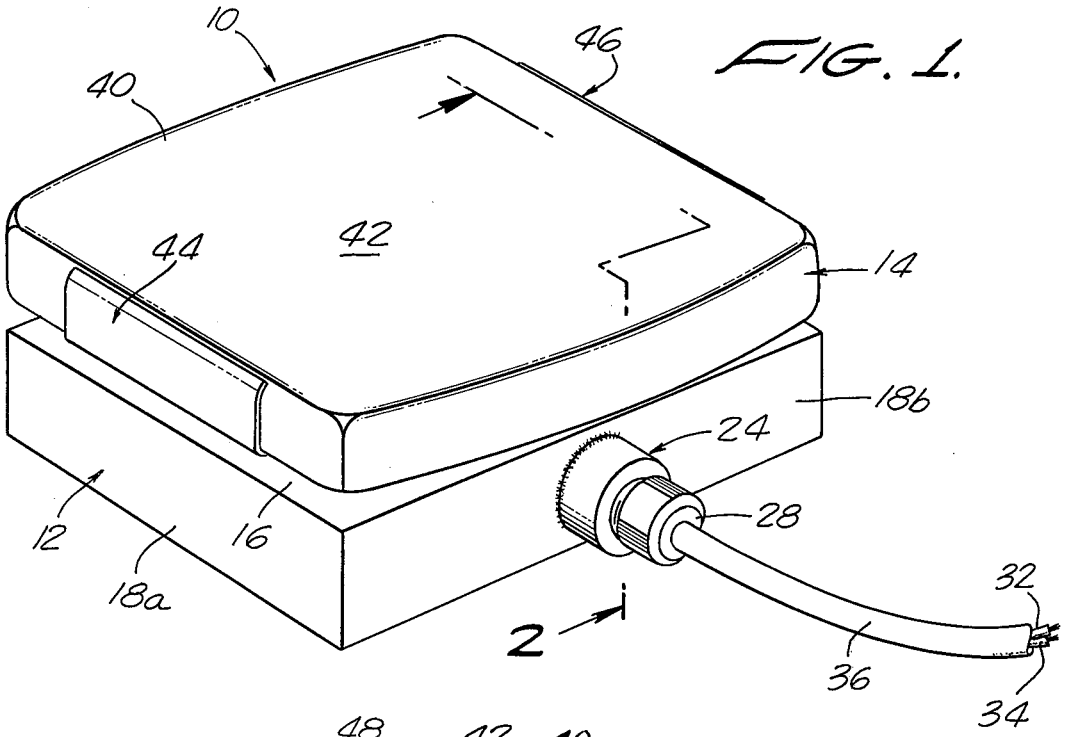
FIG. 1 is a perspective view showing a hot plate constructed in accordance with the present invention.

Referring now to the drawing, shown there in FIG. 1 is a hot plate 10 constructed in accordance with the invention. The hot plate 10 includes a base portion 12 upon which is operatively mounted a heated frame portion 14.

Figure 3:
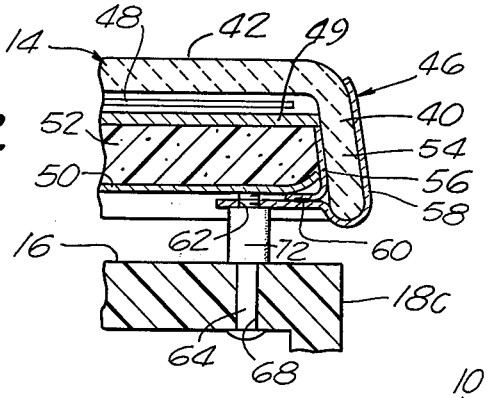
FIG. 3 is a partial, cross-sectional view taken along the line 3—3 of FIG. 2.

The base portion 12 may be formed by, for example, injection moulding using a suitable plastic material preferrably from a class known as fluorocarbons. As best seen in FIGS. 1 and 3, the base portion 12 includes a top wall 16, side walls 18*a*, 18*b* as well as the respective opposite walls thereto, not shown, and a bottom wall 20. Each of the side walls 18*a*, 18*b*, and 18*c* is provided with a recess 22, reference FIG. 3, to receive the bottom wall 20 during assembly. The top wall 16 and depending side walls define an internal wiring compartment 17.

Mounted on the side wall 18*b* is a coupling member 24 having an internal threaded region 26 of predetermined length for receiving a conventional compression fitting 28. The coupling 24 may be integrally molded with the base portion 12, if desired. Passing through the side wall 18*b* and in concentric alignment with the threaded region 26 is an opening 30 of suitable diameter to permit the passage of electrical conductors 32 and 34. For the conductors 32 and 34, it is preferred that wire coated with a fluorocarbon material be used. A plastic tube 36 which may be of the shrink tubing type and preferably made of fluorocarbon materials is also provided to carry the conductors 32 and 34 between a source of power, not shown and the base portion 12.

Figure 2:
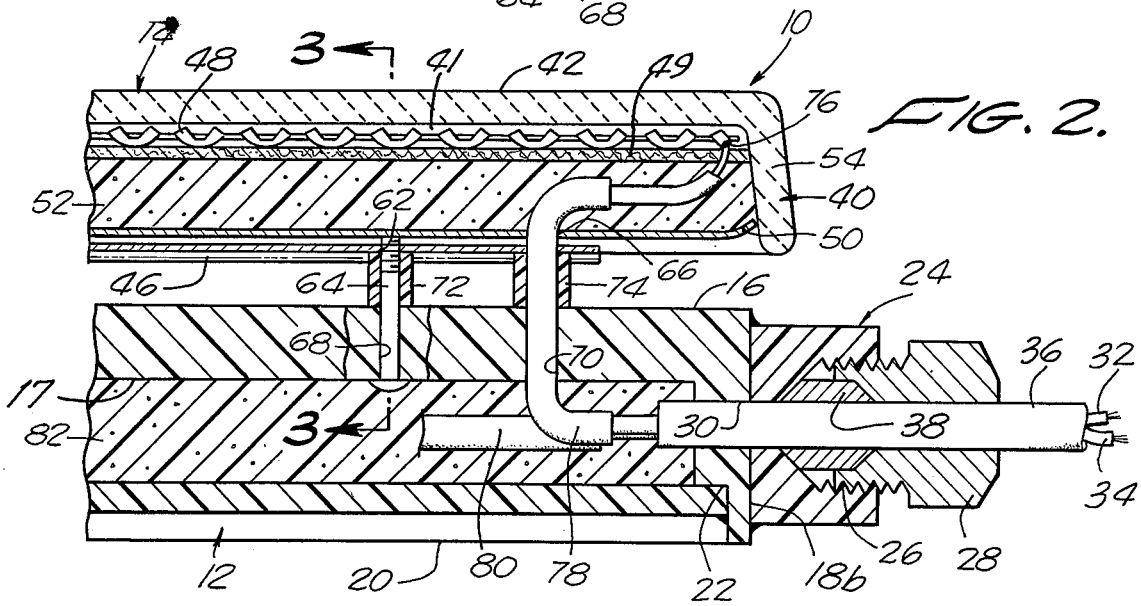
FIG. 2 is an enlarged, partial cross-sectional view taken along the line 2—2 of FIG. 1.

Disposed within the coupling member 24 and surrounding the tubing 36 is a tapered ring insert 38 which, upon properly mounting the fitting 28 into the coupling 24 causes the insert 38 to be compressed against the tubing 36 and the conductors 32 and 34. When installed in this manner the conductors 32 and 34 and the tubing 36 are securely fastened to the base portion 12 at the coupling 24. In addition, a very effective seal is provided to prevent all chemicals from coming into contact with the conductors 32 and 34 since the tubing 36 terminates inside the base portion 12 as shown in FIG. 2.

The heated frame portion 14 includes a ceramic body 40 having a top deck defining an upper external planar working surface 42, a pair of mounting clips 44 and 46, a ribbon heater element 48, a backing plate 50 and a heat resistant foam layer 52 disposed between the backing plate 50 and the heating element 48. A fibrous pad or layer 49 separates the heating element from the epoxy foam layer 52.

The ceramic body 40 is provided with turned-down edges 54 along the periphery of the working surface 42 and defining a peripherally continuous depending wall. The deck and depending peripheral wall of the ceramic body 40 define a heater compartment 41. The mounting clips 44 and 46, as best seen in FIG. 2, have two spaced apart, up-turned brackets 56 and 58 welded together as depicted by a reference numeral 60 and are formed to fit snugly on the edges 54. Threaded openings 62 are provided in the clips 44 and 46 to receive conventional fasteners 64 for assembling, to be described. The backing plate 50, reference FIGS. 2 and 3, is also provided with openings 66 to receive the conductors 32 and 34.

It should be pointed out that openings 68 are also provided in the top wall 16 for receiving the fasteners 64 and that similar openings 70 in the top wall 16 are provided for the electrical conductors 32 and 34 to pass through from the base portion 12 to the frame portion 14. Spacers 72 and 74 of predetermined length and preferably made from fluorocarbon materials are provided for the fasteners 64 and the conductors 32 and 34 respectively. It should be noted that the conductors 32 and 34 terminate at respective opposite ends of the heating element 48, as shown in FIG. 2 by a numeral 76. As best seen in FIG. 3, each of the conductors 32 and 34 is carried in plastic tubing 78 and 80 respectively, between the frame portion 14 and the base portion 12. The plastic tubing 78 and 80, which may be similar to the tubing 36, terminates respectively within the foam layers 52 in the frame portion 14 and within a foam layer 82 provided in the space between the top wall 16, the sides 18 and the bottom wall 20.

As for the foam layers 52 and 82, a two component, fast setting, low temperature curing epoxy foaming system of any type commercially available may be used. Assuming the epoxy materials have been mixed as per instructions, and the ribbon heater element 48 has had the conductors 32 and 34 properly attached at the terminals 76 and has also been properly positioned in the ceramic body 40, which may be done best with the ceramic body 40 placed upside down, relative to that shown on the drawing, and on a work surface, and each of the plastic tubing 78 and 80 has been slipped on the conductors 32 and 34 respectively, then, with that done, a predetermined amount of the epoxy material is spread over the ribbon heater element 48. The conductors 32 and 34 along with the respective plastic tubing 78 and 80 are now passed through openings 66 in the back plate 50 and the back plate 50 positioned in place over the epoxy materials, which ultimately becomes the foam layer 52. The mounting clips 44 and 46 may now be positioned in the down-turned edges 54 of the ceramic body 40.

The frame portion 14 is now attached to the base portion 12 by way of the threaded fasteners 64 which extend through the openings 68 in the top wall 16 from the bottom side as seen in the drawing and then through the spacers 72 and ultimately into the threaded openings 62 of the mounting clips 44 and 46.

Just prior to this, however, the conductors 32 and 34 together with the plastic tubing 78 and 80 are passed through the spacers 74 and hence through the two spaced apart openings 70. At a predetermined point below the top wall 16 the plastic tubing 78 and 80 is terminated. From that point on to the source of electrical power, if necessary, the conductors 32 and 34 are carried within the single plastic tubing 36, through the opening 30, the coupling member 24, the tapered insert ring 38 and the fitting 28.

With the conductors 32 and 34 positioned as pointed out above, and after the fasteners 64 are securely tightened, another predetermined amount of the mixed epoxy materials is applied over the conductors 32 and 34 and within the region defined by the bottom surface of the top wall 16, the inner surface of the side walls 18*a*, 18*b* and the walls, not shown, opposite thereof, up to the lower part of the recess 22, when viewed in an inverted position relative to that shown in the drawing.

At this point the bottom wall 20 is positioned within the recess 22 of the side walls 18*a*, 18*b*, etc. over the mixture of epoxy materials which on becoming cured has expanded to become the foam layer 82. If desired, the bottom wall 20 may be permanently or removably attached to the base portion 12 by suitable adhesives or other commonly known methods.

It should be noted that the heat resistant epoxy foam layer 52 serves to prevent any chemically active agents from making contact with the heater element 48. Similarly, the foam layers 52 and 82 prevent such similar agents from coming into contact with the conductors 32 and 34 in the event these agents were to eventually find a path between the spacers 74 and the openings 66 and 70 respectively of the backing plate 50 and the top wall 16. As for that portion of the conductors 32 and 34 that is exterior of the coupling 24, the tubing 36 provides the desired protection.

It should be stated that a ceramic hot plate, Model PC-35, made of "Corningware", a registered trademark of the Corning Glass Works, Corning, N.Y., and having suitable mounting clips, a ribbon heating element and a back plate is available from the Corning Glass Works and can be used in conjunction with the present invention as described above.

While I have herein shown and described my invention in what I have conceived to be the most practical and preferred embodiment, it is recognized that departures may be made therefrom within the scope of my invention, which is not to be limited to the details disclosed herein but is to be accorded the full scope of the claims so as to embrace any and all equivalent devices and methods.

I claim:

1. A hot plate comprising in combination a top portion having a top ceramic deck defining a heated working surface, the deck also having down-turned edges defining a peripherally continuous depending wall, there being a heater compartment beneath the deck and within the depending wall; a heating element operably disposed in said heater compartment below said working surface and having electrical terminals; circuit means for supplying electrical energy from a power source to said terminals; a base portion for operably supporting said top portion in thermal isolation therefrom; and means including epoxy foam beneath the heating element and extending across and substantially filling the heater compartment, the epoxy foam providing a seal to the depending wall and cooperating with the deck and depending peripheral wall for encapsulating said heating element and said circuit means to confine substantially all of the heat generated to said working surface, said base portion being constructed of fluorocarbon materials as a separate structure and attached to said top portion in spaced apart configuration to further provide additional thermal isolation between said heated working surface and said base portion, said circuit means extending through said base portion for protection from heat and hostile environments.

2. The hot plate constructed in accordance with claim 1 further characterized in that the base portion has a top wall in confronting and spaced relation to the top portion, the base portion also having a peripherally continuous side wall depending from the top wall and formed integrally and in one piece with the top wall and cooperating with the top wall in defining a wiring chamber confining the circuit means therein, and means including epoxy foam filling and sealing closed said wiring chamber of the base portion to encapsulate and protect said circuit means disposed therein from hostile environments.

3. The hot plate constructed in accordance with claim 2 wherein the circuit means includes wiring extending from the base portion and into the top portion and spanning the open space therebetween, the wiring being enclosed within a chemically resistant protective tubular sheath of fluorocarbon material and spanning with the wiring the open space between the base and top portions, the ends of the tubular sheath and wiring being embedded and sealed in the epoxy foam of both the base and top portions.

* * * * *